US005828386A

United States Patent [19]

Okada et al.

[11] Patent Number: 5,828,386

[45] Date of Patent: Oct. 27, 1998

[54] RECORDING HEAD AND APPARATUS FOR DETECTING CONTACT CONDITION

[75] Inventors: Masaaki Okada, Sanjou; Yoshiyuki Imanaka, Kawaski; Yuji Kamiyama, Sapporo, all of Japan

[73] Assignee: Canon Kabushiki Kaisha, Tokyo, Japan

[21] Appl. No.: 614,890

[22] Filed: Mar. 13, 1996

[30] Foreign Application Priority Data

Mar. 17, 1995 [JP] Japan ..... 7-058468

[51] Int. Cl.[6] ..... B41J 29/38

[52] U.S. Cl. ..... 347/9; 361/86

[58] Field of Search ..... 347/9; 346/74.2; 361/86

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,639,735 | 1/1987 | Yamamoto et al. | 347/68 |
| 4,723,129 | 2/1988 | Endo et al. . | |
| 4,740,796 | 4/1988 | Endo et al. . | |
| 4,890,183 | 12/1989 | Champiau | 361/86 |
| 5,083,137 | 1/1992 | Badyal et al. | 347/14 |
| 5,114,252 | 5/1992 | Tanuma et al. . | |
| 5,357,268 | 10/1994 | Kishida et al. . | |
| 5,371,530 | 12/1994 | Hawkins et al. | 347/9 |

FOREIGN PATENT DOCUMENTS

| | | |
|---|---|---|
| 54-051837 | 4/1979 | Japan . |
| 54-056847 | 5/1979 | Japan . |
| 57-159673 | 10/1982 | Japan . |
| 59-123670 | 7/1984 | Japan . |
| 59-138461 | 8/1984 | Japan . |
| 60-071260 | 4/1985 | Japan . |
| 3281262 | 12/1991 | Japan . |
| 4164656 | 6/1992 | Japan . |
| 6305148 | 11/1994 | Japan . |
| 7040574 | 2/1995 | Japan . |

*Primary Examiner*—Stuart N. Hecker

*Attorney, Agent, or Firm*—Fitzpatrick, Cella, Harper & Scinto

[57] ABSTRACT

A recording head utilizes an AND circuit which performs logical product between inputs from signal input terminals and a warning signal output terminal which outputs a result of the AND circuit. A recording apparatus in which the recording head is installed has a control circuit which supplies a high level signal to the signal input terminals and which inputs a warning signal from the warning signal output terminal. The control circuit judges that the contact of the recording apparatus with the recording head is good if the warning signal is a high level, or judges that the contact is poor if it is not so.

38 Claims, 10 Drawing Sheets

FIG.10A
PRIOR ART
FIG.10B
PRIOR ART
FIG.10C
PRIOR ART
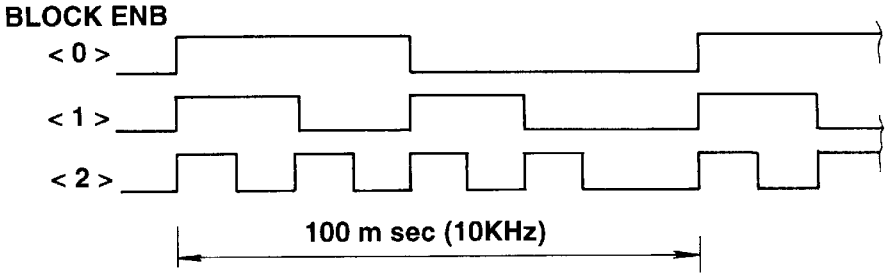
FIG.10D
PRIOR ART
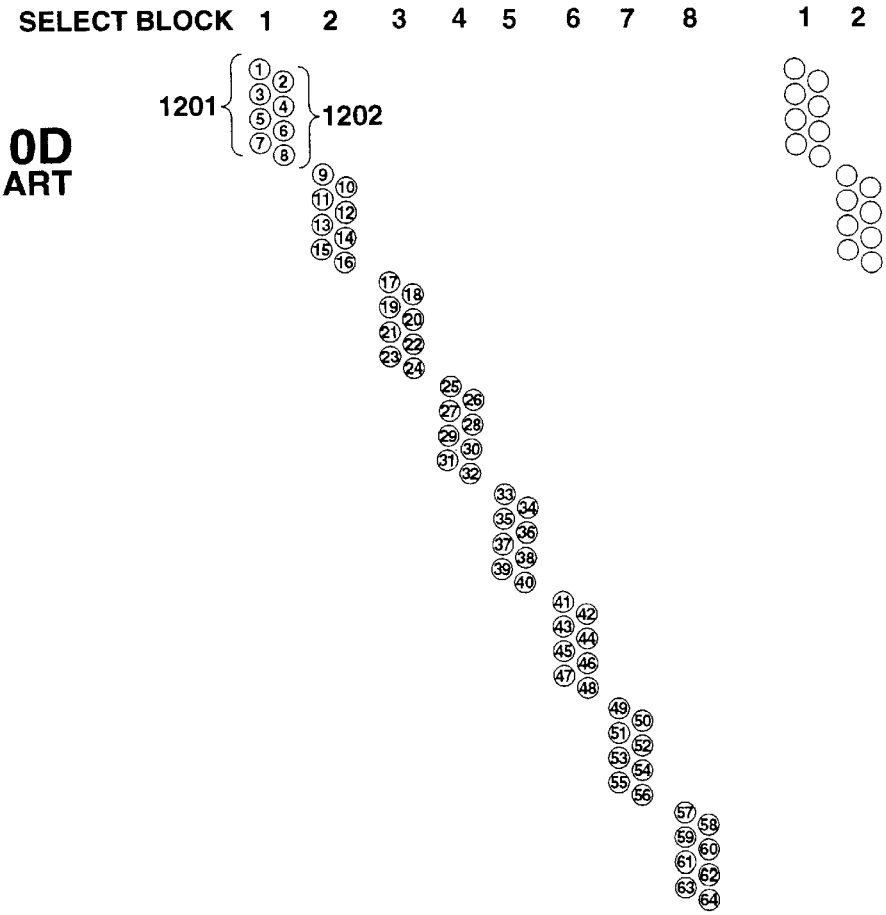

FIG.11A
PRIOR ART
FIG.11B
PRIOR ART
FIG.11C
PRIOR ART
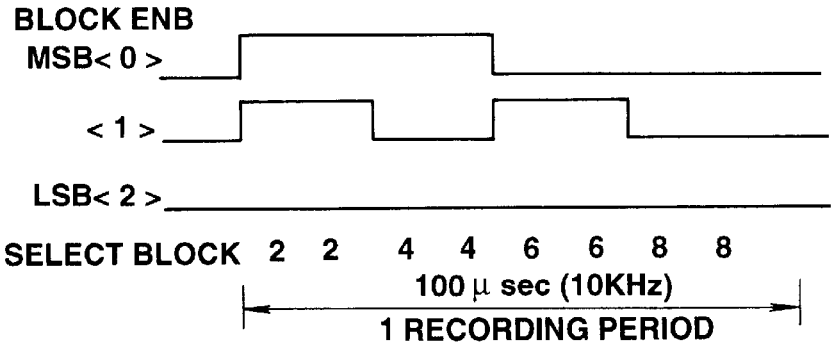
FIG.11D
PRIOR ART
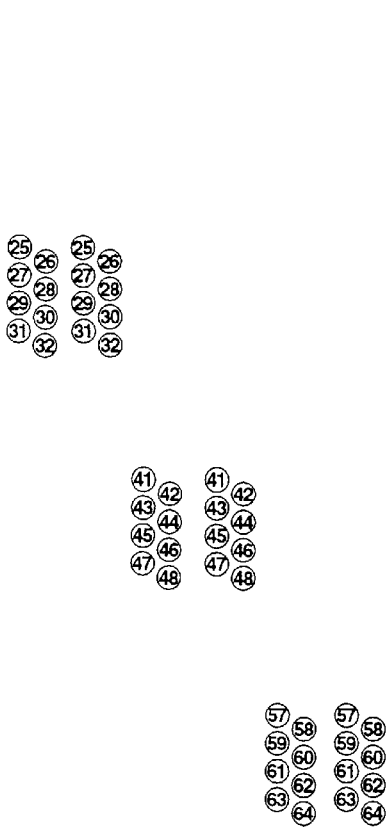

RECORDING HEAD AND APPARATUS FOR DETECTING CONTACT CONDITION

BACKGROUND OF THE INVENTION

1. Field of the Invention

This invention relates to a recording head and a recording apparatus using the recording head. More specifically, this invention relates to a recording head which performs recording by an ink jet system and a recording apparatus using the recording head.

2. Description of the Related Art

Up to this time, an ink jet printer has attracted attention by having various advantages. For example, the printer offers advantages of making the noise generated during printing negligibly small, being able to print at high speed, and being able to print onto a plain paper without a special process.

One ink jet printing method, such as disclosed in Japanese Laid-Open Patent Application No. 54-51837 and U.S. Pat. No. 4,723,129 are characterized by making thermal energy act on a liquid ink to create a force to discharge the ink.

More specifically, according to the method disclosed in the above-mentioned documents, a state change occurs in the liquid ink acted on by the thermal energy which causes rapid enlargement of the volume. A liquid droplet is consequently discharged from an orifice of a recording head section by the force generated by the state change and the liquid droplet is deposited onto a recording medium such as recording paper to thereby effect recording.

The ink jet printing method disclosed in the above-noted documents can not only be applied effectively to so called drop-on-demand type recording but also can obtain an image with high resolution, high quality and at high speed since a recording head on which multiple orifices are arranged with high density can be easily utilized in the method.

The recording head of the printer apparatus which is applicable to the above-mentioned printing method includes a recording head body. The recording head body comprises an orifice to discharge liquid drops, a liquid flow path associated with the orifice where the thermal energy to discharge liquid droplets acts on the liquid ink and an electro-thermal converter (heater or heating element) as the means to generate the thermal energy.

Plural electro-thermal converters are formed by a semiconductor forming process on the same board of the recording head body with plural heater drivers corresponding to the plural heaters being arranged in a row on a one-for-one basis to respectively drive each heater according to input image data, a shift register which stores the same bit number of image data as the number of heat elements to output the image data input serially to each driver and a latch circuit which temporarily memorizes the data output from the shift register. In more detail, the above-mentioned circuit is formed by a bipolar transistor called a Bi-CMOS or C-MOS transistor formed on a silicon board. By forming heat elements on the IC, the recording head body is structured.

FIG. 8 is a circuit diagram showing the conventional recording head body provided with 64 recording elements. In FIG. 8, 101 represents heaters (Heater 1, Heater 2, . . . , Heater 64), 64 of which are arranged in a row, 102 represents a plurality of power transistors, 103 is a latch circuit and 104 is a 64 bit shift register. Reference numeral 105 is a clock input terminal in which a clock signal (Clock) to effect shift register operation is input, 106 is an image data input terminal in which image data (Idata) is input, and 107 is a strobe input terminal in which a heat pulse width control signal (HeatENB) to control ON times of the power transistors 102 from the outside is input. Reference numeral 108 is a logic circuit power supply input terminal, and 109 is a GND terminal (L-GND) of a logic circuit, which is comprised of latch circuit 103, shift register 104, and a decoder 112 (described below). Reference numeral 110 is a heater drive power supply (VH) input terminal, 111 is a GND terminal (H-GND) of the power transistor 102, 116 is a latch signal input terminal in which a latch signal (LTCLK) is input, 117 is a reset signal input terminal in which a reset signal (Reset) to make the latch circuit 103 reset is input and 118 are AND circuits.

In a recording head of an ink jet system, ink supply (refill) from an ink tank improves and it does not detrimentally affect recording image quality by reducing the number of elements which discharges ink at the same time, so that a high quality image can be obtained. Accordingly, plural recording elements provided with the recording head are divided into two or more blocks to drive them at different timings and are driven so as not to discharge ink at the same time from recording elements adjacent each other.

For example, 64 recording elements are divided into 8 blocks each having 8 elements in the recording head shown in FIG. 8 and a recording operation is performed for each block. In addition, in the same block odd number recording elements and even number recording elements perform recording at different timings so as not to discharge ink at the same time from adjacent recording elements. For this reason, input terminals 113 in which 3-bit block select signals (BlockENB) are input, an input terminal 114 in which odd number element select signal (OddENB) is input, an input terminal 115 in which even number element select signal (EvenENB) is input and a decoder 112 are provided. The odd number element select signal (OddENB) is a control signal that selects odd number heaters among all heaters 101 (Heater 1, Heater 2, . . . , Heater 64) as shown in FIG. 8 in order to discharge ink. On the other hand, the even number element select signal (EvenENB) is a control signal that selects even number heaters in order to discharge ink. The decoder 112 selects one of 8 blocks according to the 3-bit block select signal (BlockENB).

In the printer having the recording head formed as described above, image data (Idata) is input serially to the shift register 104 from the image data input terminal 106. When 64-bit image data are input to the shift register 104, the input image data are latched in the latch circuit 103. And, when the latched data and heat pulse width control signal (HeatENB) input from the input terminal 107 coincide and the power transistors 102 of odd number blocks or even number blocks are selected by the decoder 112, corresponding heaters 101 are driven. When ink within an ink path corresponding to a driven heater 101 is heated, ink is discharged from a discharge opening and image recording is performed.

As mentioned above, a drive circuit of an ink jet recording head for high quality recording is structured by two or more blocks as shown in FIG. 8. This structure can prevent ink from being concentratedly supplied to the recording head from an ink tank, so the ink can be supplied smoothly. In addition, ink supply to an ink nozzle from an ink liquid chamber can be stabilized by not discharging ink at the same time from adjacent recording elements.

FIG. 9 is a perspective view showing structure of a conventional recording head of an ink jet system. In FIG. 9, 301 are liquid path walls for dividing liquid paths, 302 are the liquid paths, 303 is a ceiling plate, 304 are discharge openings, 305 is a common ink liquid chamber supplying ink to the plural liquid paths and 306 is a ink supply tube supplying ink to the common ink liquid chamber 305 from an ink tank (not shown). Reference numeral 201 is a Si (silicon) board, 255 are heat elements and 220 are Al (aluminium) wirings.

For example, in the case of the recording head having 64 recording elements (64 ink discharge openings), each block having 8 recording elements is divided into 8 (select block 1, 2, . . . , 8 in FIG. 10D) using the decoder 112 according to the combination of values of each bit of the 3-bit block select signals (BlockENB) shown in FIGS. 10A–10C. Recording elements within each block are divided into odd number recording element group 1201 and even number recording element group 1202 and are controlled to discharge ink (hereinafter, referred to as block driving).

In FIG. 10D, each circle represents the picture element recorded by each recording element and the number given within each circle distinguishes between 64 recording elements. Moreover, since ink jet recording is at high speed, the recording frequency of all the recording elements (in this case, 64) is more than 10 kHz. The recording period is less than 100 microseconds, so one heat pulse width is only a few microseconds.

In the above-mentioned conventional example, even if one terminal becomes disconnected among the power supply system terminals (for example, terminals 108, 110) and the system terminals (for example, terminals 105, 106) of the recording head shown in FIG. 8, recording defects such as lack of recording dots will occur. In addition, if a problem occurs with respect to logic of the logic circuit having signal system terminals, such as a contact becoming poor, the recording head may be destroyed.

For example, the decoder 112 shown in FIG. 8 is generally used by generating block select signals. The circuit shown in FIG. 8 has a characteristic that it has a small number of elements and has a small number of terminals. However, in the control that divides blocks using a decoder, if a contact between decoder input terminal (in case of FIG. 8, the input terminals 113) becomes poor, not only will recording be performed poorly but also the recording head may be destroyed.

FIGS. 11A–11D show the block select signals and recording at the time when the contact of the LSB (Least Significant Bit) bit (<2>in FIG. 11C) is disconnected among the 3-bit block select signals (BlockENB) by contact inferiority. In such case, if the decoder 112 operates under negative logic, a selected block will be shown in FIG. 11D. The same block which must be driven a maximum of one time during one recording period in normal operation will be driven twice during one recording period. In other words, a recording element is heated twice during a few tens of microseconds. In an ink jet recording head, when it is heated once, the heater temperature rises to several hundred degrees C, so it takes more than 30 microseconds to return to the normal temperature. Heating heaters twice during a few tens of microseconds means applying double electric power to the heaters during each drive. If such severe electric power as described above is applied to the heaters, they may be broken.

SUMMARY OF THE INVENTION

One object of the invention is to provide a recording head which can be prevented from being destroyed or from recording poorly by contact inferiority, and to provide a recording apparatus using such a recording head.

It is another object of the invention to provide a recording head which can be prevented from being destroyed or from recording poorly by contact inferiority in a block driving method, and to provide a recording apparatus using such a recording head.

It is still another object to provide a checking method which can check a connection between a recording head and a recording apparatus.

According to one aspect of the invention there is provided a recording head having a plurality of recording elements divided into a plurality of blocks. The head includes a select signal terminal, a selector, a monitor and a monitor terminal. The select signal terminal inputs a select signal that designates at least one block among the plurality of blocks to be driven. The selector selects at least one block designated by the select signal. The monitor monitors a connection condition of the select signal terminal. The monitor terminal outputs a monitor signal to indicate the monitored connection condition.

According to another aspect of the invention there is provided an ink jet head cartridge including a recording head and an ink tank. The recording head has a plurality of recording elements divided into a plurality of blocks. The recording head includes a select signal terminal for inputting a select signal that designates at least one block among the plurality of blocks to be driven, a selector for selecting at least one block designated by the select signal, a monitor for monitoring a connection condition of the select signal terminal, and a monitor terminal for outputting a monitor signal to indicate the monitored connection condition. The ink tank holds ink to be supplied to the recording head.

According to yet another aspect of the invention there is provided a recording apparatus for recording onto a recording medium using a recording head having a plurality of recording elements divided into a plurality of blocks, a select signal terminal for inputting a select signal that designates at least one block among the plurality of blocks to be driven, a selector for selecting at least one block designated by the select signal, a monitor for monitoring a connection condition of the select signal terminal, and a monitor terminal for outputting a monitor signal to indicate the monitored connection condition. The apparatus includes applying means, inputting means and informing means. The applying means applies a predetermined voltage to the select signal terminal. The inputting means inputs the monitor signal outputted from the monitor terminal. The informing means informs a user of the monitored connection condition between the recording head and the recording apparatus according to the monitor signal.

According to still another aspect of the invention there is provided a recording apparatus for recording onto a recording medium and including a recording head, applying means, inputting means and informing means. The recording head has a plurality of recording elements divided into a plurality of blocks. The recording head comprises a select signal terminal for inputting a select signal that designates at least one block among the plurality of blocks to be driven, a selector for selecting at least one block designated by the select signal, a monitor for monitoring a connection condition of the select signal terminal, and a monitor terminal for outputting a monitor signal to indicate the monitored connection condition. The applying means applies a predetermined voltage to the select signal terminal. The inputting means inputs the monitor signal outputted from the monitor terminal. The informing means informs a user of the monitored connection condition between the recording head and the recording apparatus according to the monitor signal.

According to another aspect of the invention there is provided a checking method for checking a connection condition between a recording head and a recording apparatus. The method includes a providing step that provides a recording head having a plurality of recording elements divided into a plurality of blocks, wherein the recording head comprises a select signal terminal for inputting a select signal that designates at least one block among the plurality of blocks to be driven, a selector for selecting at least one block designated by the select signal, a monitor for monitoring a connection condition of the select signal terminal, and a monitor terminal for outputting a monitor signal to indicate the monitored connection condition. The method also includes an applying step of applying a predetermined voltage to said select signal terminal, a monitoring step of monitoring the monitor signal outputted from the monitor terminal, and an informing step of informing a user of the monitored connection condition between the recording head and the recording apparatus according to the monitor signal.

The individual components shown in outline or designated by blocks in the drawings are all well-known in the image recording arts and their specific construction and operation are not critical to the operation or best mode for carrying out the invention.

BRIEF DESCRIPTION OF THE DRAWINGS

FIGS. 10A–10D are waveforms and an explanatory view showing a recording condition by a conventional recording head.

FIGS. 11A–11D are waveforms and an explanatory view showing a recording condition at the time of contact inferiority in a conventional recording head.

DETAILED DESCRIPTION OF THE PREFERRED EMBODIMENTS

The preferred embodiments of the present invention will now be described with reference to the drawings.

<First Embodiment>

Figure 1:
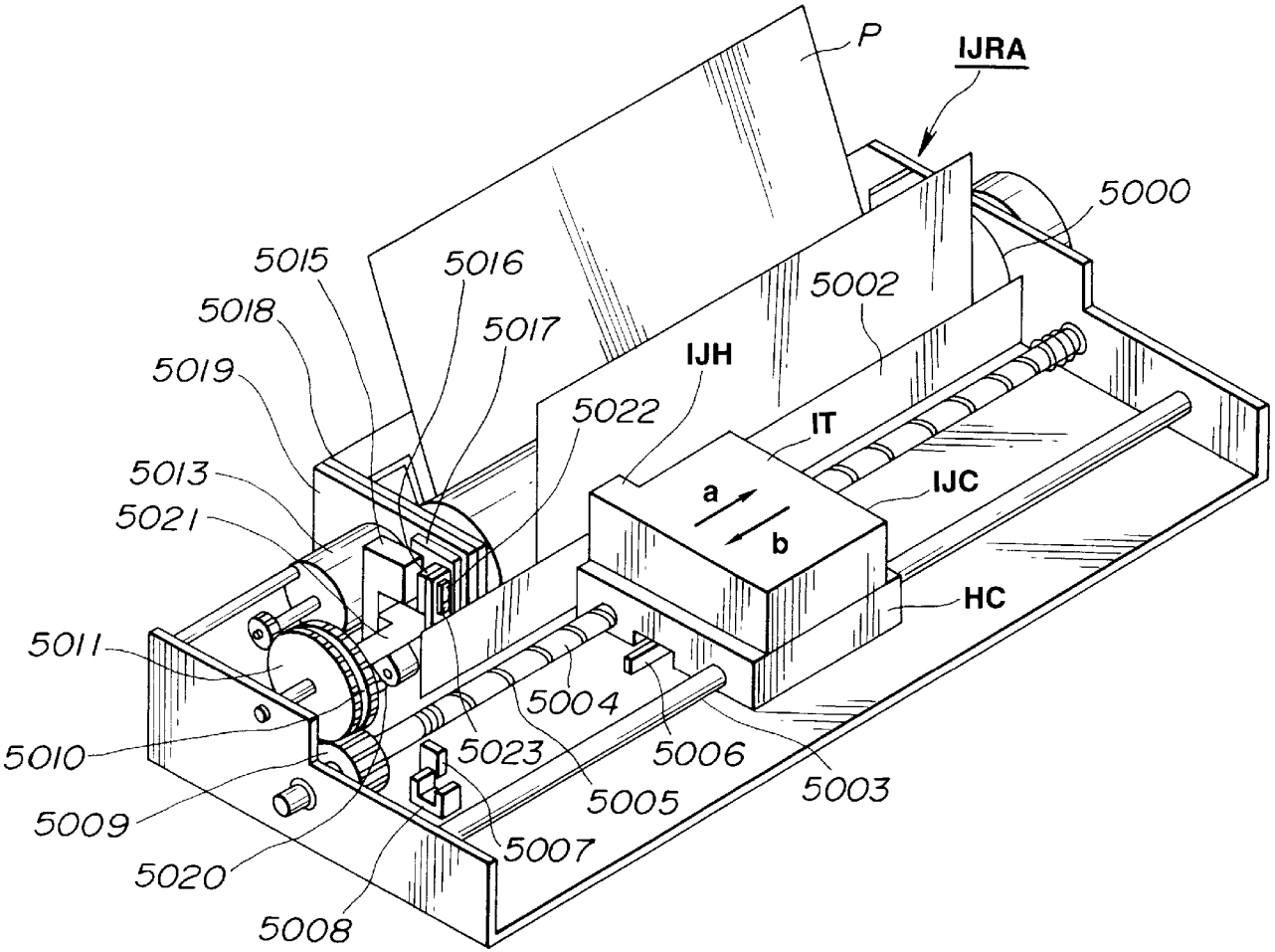
FIG. 1 is a perspective view showing structure of an ink jet recording apparatus (IJRA) or printer to which the present invention can be applied.

FIG. 1 is a perspective view showing an ink jet recording apparatus (IJRA) to which the present invention can be applied. Referring to FIG. 1, a carriage HC engages a spiral groove 5005 of a lead screw 5004, which is, through rotational-force transmission gears 5009 to 5011, rotated in synchronization with forward/reverse rotations of a drive motor 5013. The carriage HC has a pin (not shown) by means of which the carriage HC is reciprocated in the directions indicated by arrows a and b along a supporting guide rail 5003. The carriage HC has an ink jet cartridge IJC including a recording head IJH and an ink tank IT mounted thereon. The ink tank IT is filled with ink. Reference numeral 5002 represents a paper retaining plate which presses paper against a platen 5000 in a direction transverse to the directions, in which the carriage HC is moved. Reference numerals 5007 and 5008 represent a photocouple to serve as a home position detecting means which checks for the presence of a lever 5006 on the carriage HC in the region between them in order, for example, to switch the rotational direction of the motor 5013. Reference numeral 5016 represents a member for controlling a capping member 5022 which caps the discharge surface of the recording head. Reference numeral 5015 represents a suction device for suctioning the inside portion of the capping member 5022, the suction device 5015 being arranged to recover the recording head by suctioning viscous or dried ink, dust and debris through an opening 5023 in the capping member 5022. Reference numeral 5017 represents a cleaning blade which is moved forward/rearward by a member 5019. Reference numeral 5018 represents a support so integrally formed with the body of the ink jet recording apparatus to support the cleaning blade 5017 and the member 5019. The blade is not limited to that shown in this figure, but any suitable known cleaning blade may be applied to this embodiment. Reference numeral 5021 represents a lever for starting the suction operation for suction recovery, the lever 5021 being moved by a cam 5020 on the carriage HC as the carriage is moved into and out of its home position. The drive force of the drive motor 5013 is used to control the movement of the carriage HC via a known transmission device, such as a clutch mechanism.

The foregoing capping, cleaning and suction recovery operation can be performed at corresponding positions by the operation of a lead screw 5004 when the carriage HC has been brought to the home position region. The foregoing operations are performed at a predetermined timing.

The control structure to perform recording control of the above mentioned apparatus will now be explained.

Figure 2:
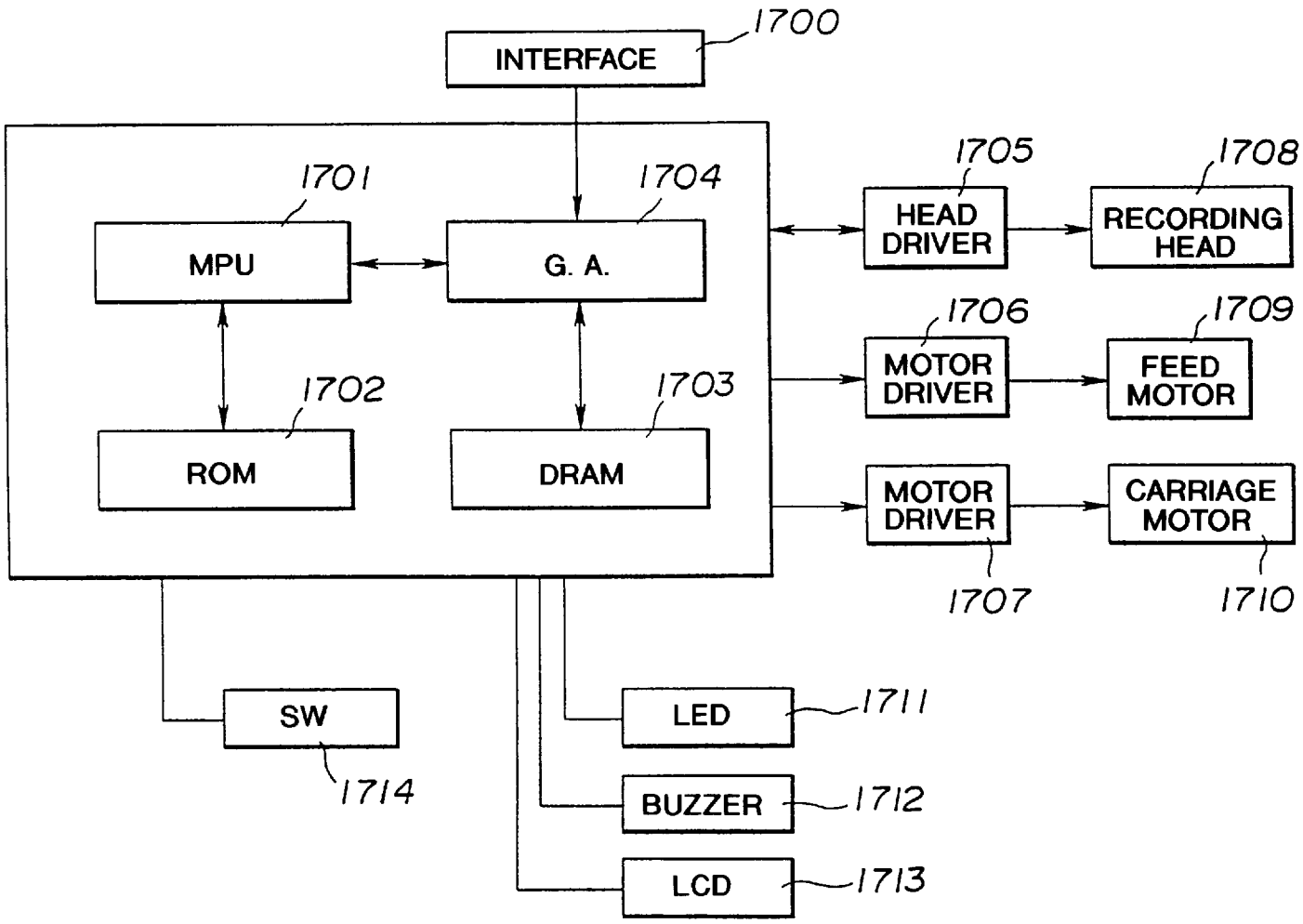
FIG. 2 is a block diagram showing structure of a control circuit of the ink jet printer IJRA of FIG. 1.

FIG. 2 is a block diagram showing a structure for controlling the ink jet recording apparatus shown in FIG. 1. Referring to FIG. 2, reference numeral 1700 represents an interface through which recording signals are received, 1701 represents an MPU, 1702 represents a ROM for storing a control program to be executed by the MPU 1701, printing information supplied from a host computer so as to be printed and the like, and reference numeral 1703 represents a DRAM for storing a variety of data items (the foregoing recording signals and data to be supplied to the recording head so as to be recorded and the like).

Reference numeral 1704 represents a gate array for controlling supply of data to be transmitted to a recording head 1708. The gate array 1704 also controls data transfer among the interface 1700, the MPU 1701 and the DRAM 1703. Reference numeral 1710 represents a carrier motor for moving the recording head 1708.

Reference numeral 1709 represents a feed motor for feeding recording paper, and 1705 represents a head driver for operating the recording head 1708. Reference numeral 1706 represents a motor driver for driving the feed motor 1709. Reference numeral 1707 represents a motor driver for driving the carrier motor 1710.

Moreover, reference numerals 1711 and 1712 are respectively an LED that lights up and a buzzer that buzzes or rings to inform a user when it is detected that the recording head IJH is not connected to the recording apparatus IJRA correctly. Reference numeral 1713 is an LCD which displays a message along with LED 1711 lighting and buzzer 1711 ringing to indicate a connection condition between the recording head IJH and the recording apparatus IJRA, and 1714 is an indication switch (SW) to check a connection condition between the recording head IJH and the recording apparatus IJRA at any time.

In the recording apparatus structured as described above, when information is supplied from a host computer through the interface 1700, the gate array 1704 and the MPU 1701 convert the supplied information into information to be printed. As a result, the motor drivers 1706 and 1707 are operated accordingly, and as well, the recording head 1708 is operated in accordance with the information supplied to the head driver 1705 so that printing is performed.

A warning signal (FB) to be described later is fed back to the control circuit from the recording head IJH through the head driver 1705.

Figure 3:
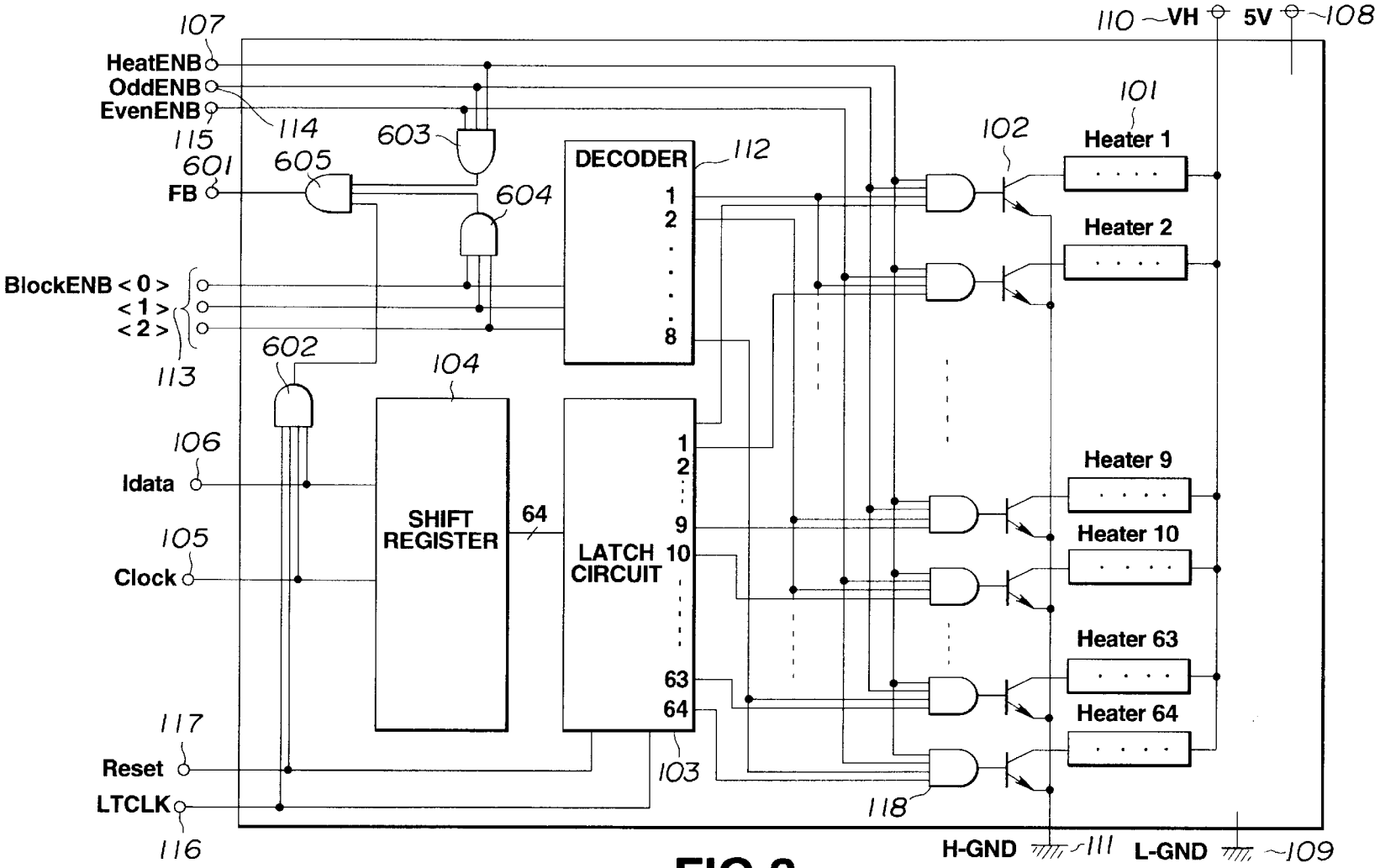
FIG. 3 is a block diagram showing structure of a circuit board of a recording head or ink jet head (IJH) according to the present invention.
Figure 8:
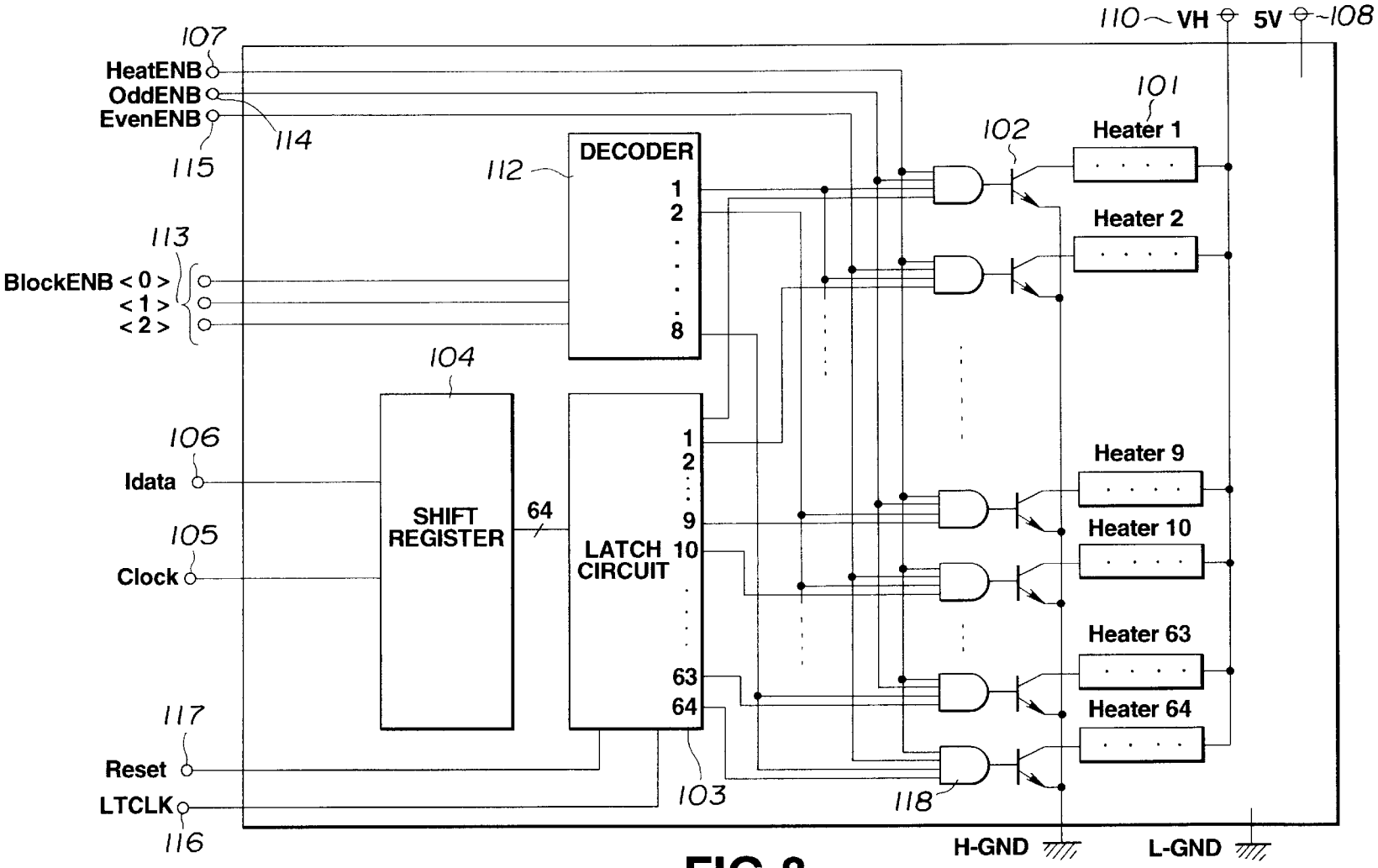
FIG.8 PRIOR ART
FIG. 8 is a block diagram showing a drive circuit of a conventional recording head.
Figure 9:
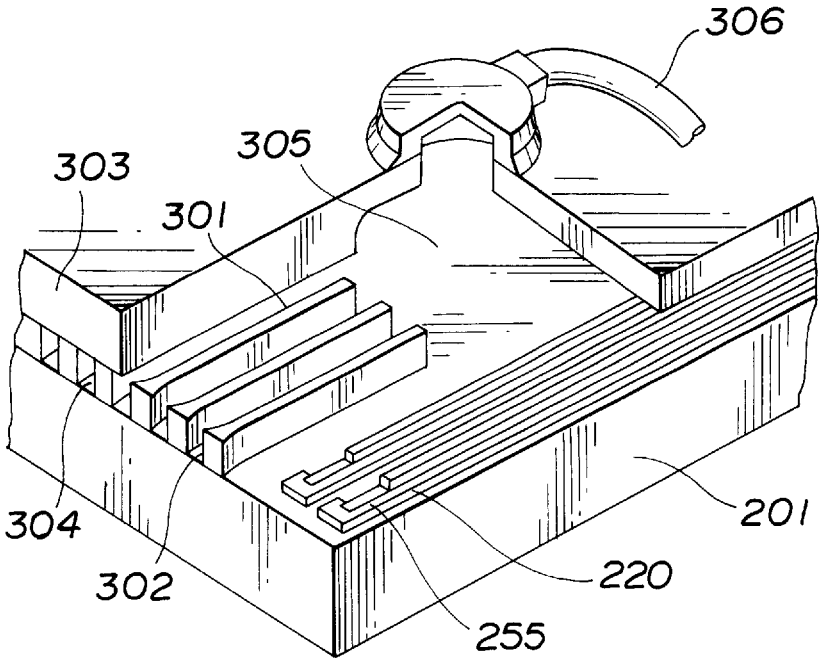
FIG.9 PRIOR ART
FIG. 9 is a perspective view showing structure of the conventional recording head of an ink jet system.

FIG. 3 is a block diagram showing structure of a circuit board of the recording head (IJH) of the present invention. In FIG. 3, certain elements are assigned the same reference number as like elements of the conventional recording head shown in FIG. 8 and will not be described further. In addition, the recording head IJH has 64 recording elements 101 (heaters), and the 64 recording elements are divided into 8 blocks, each having 8 recording elements.

In FIG. 3, 601 is an output terminal outputting the warning signal (FB) which indicates there is contact inferiority between signal system terminals (terminals 105 to 107, 113 to 117) of the recording head IJH and the recording apparatus, and 602 to 605 are AND circuits. The AND circuit 602 operates logical product of input signals input from terminals 105, 106, 116, 117 and outputs the operation result to the AND circuit 605. The AND circuit 603 operates logical product of input signals input from terminals 107, 114, 115 and outputs the operation result to the AND circuit 605. The AND circuit 604 operates logical product of all of the 3-bit block select signals input from terminals 113 and outputs the operation result to the AND circuit 605. The AND circuit 605 operates logical product of output signals input from AND circuits 602 to 604 and outputs the operation result to the control circuit as the warning signal (FB).

Figure 4:
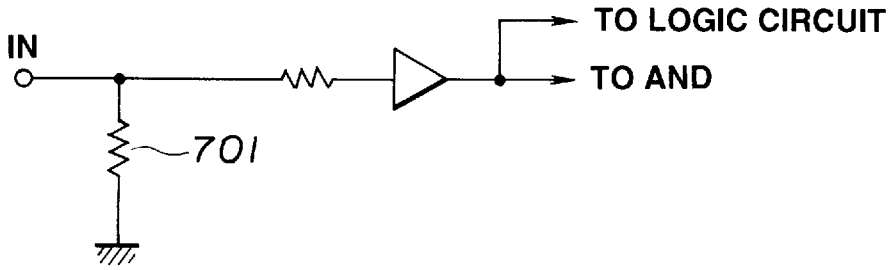
FIG. 4 is a circuit diagram showing structure of an input terminal with pull down resistance.
Figure 5:
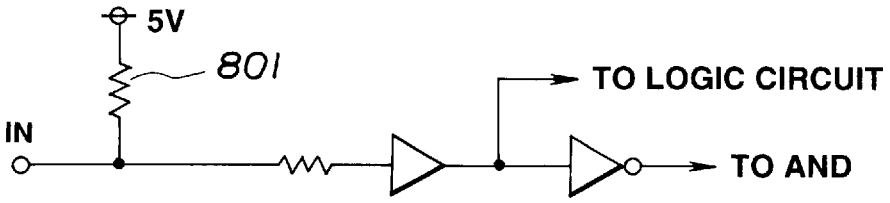
FIG. 5 is a circuit diagram showing structure of an input terminal with pull up resistance.

Pull down resistance 701 as shown in FIG. 4 is connected with each above-mentioned signal system terminal. When any terminal has contact inferiority, an output level to the AND circuits becomes GND level (in other words, "LOW" level) automatically. Instead, pull up resistance 801 as shown in FIG. 5 may be connected with each above-mentioned signal system terminal as another circuit structure. In this case, when the terminal has contact inferiority, the input section of the terminal becomes +5 V and is output to the AND circuits via an inverter 802, so that an output level to the AND circuits becomes the "LOW" level automatically.

Figure 6:
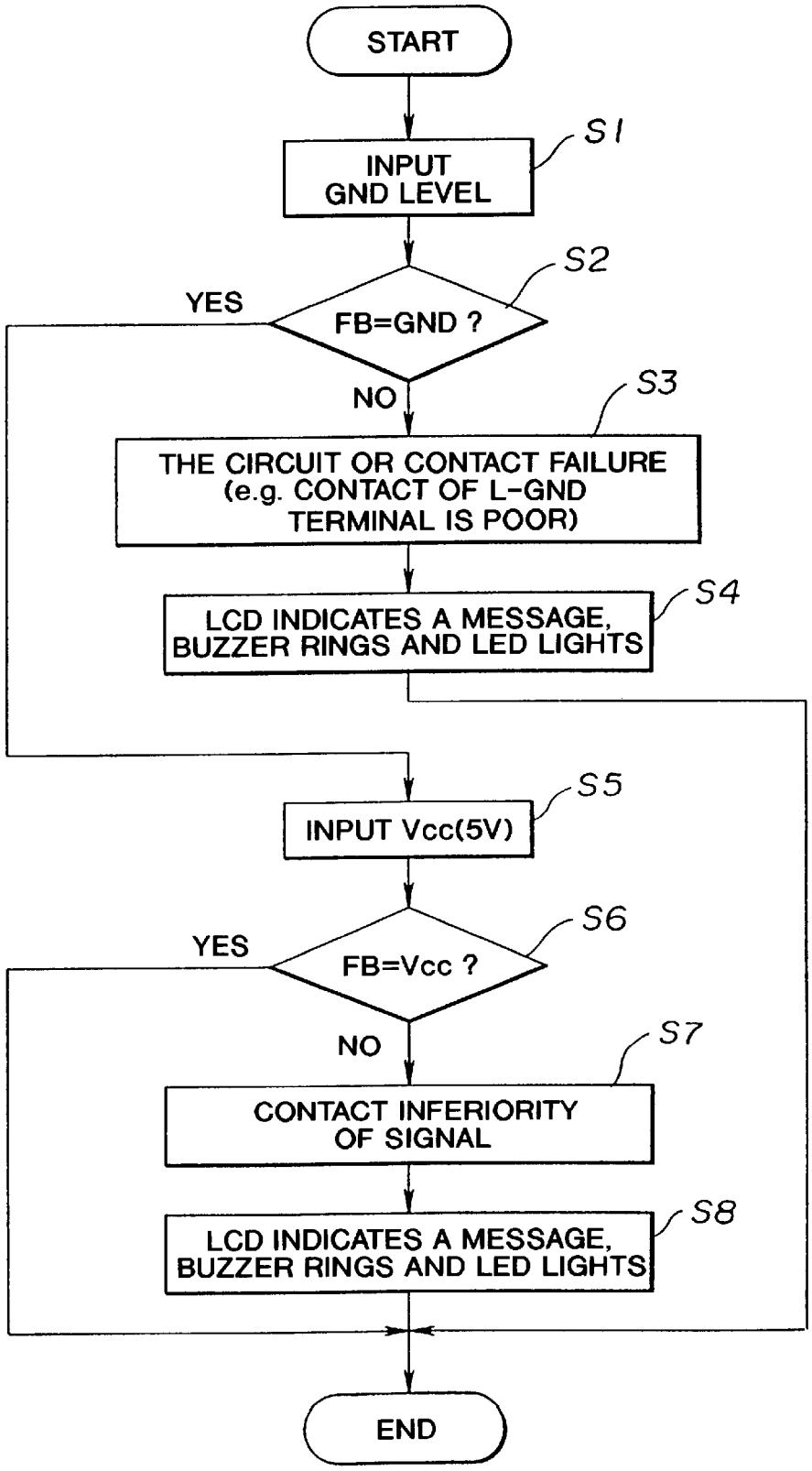
FIG. 6 is a flow chart showing a contact inferiority detection process of the recording head IJH and the recording apparatus IJRA.

Next, a contact inferior detection method in the recording apparatus IJRA which mounts on the recording head IJH of which structure is mentioned above will be explained referring the flow chart shown in FIG. 6. In the contact inferiority detection method which will be explained below, a drive power supply voltage is not applied to an input terminal for heater drive power supply (VH), so VH equals 0. In order to check contact inferiority, contacts of a power supply system (the 5 V terminal and the GND terminal) and contacts of logic system (the select signal terminal, the image signal terminal and so on) will be checked separately. Here, the contact of the power supply system needs to be checked first. This is because since a logic circuit provides specialized logic circuitry for a check of contact inferiority, if the contact of the power supply system is poor, the logic circuit may malfunction and misjudge. Therefore, the contact condition of the power supply system must be checked first of all.

First, GND level is input to all of the signal system terminals from the control circuit of the print apparatus in step S1. Next, the signal level of warning signal (FB) output from the warning signal output terminal 601 will be monitored in step S2; if the FB equals GND level then a process advances to step S5. On the other hand, if the FB equals Vcc level (usually 5 V), it is judged that there is a problem with the circuit, for example, the circuit (board) is not grounded, and the L-GND terminal 109 is disconnected in step S3 and then the process advances to step S4. In step S4, the LCD 1713 indicates a message to that effect, the LED 1711 lights up and the buzzer 1712 rings, then the process ends. In steps S1 to S4, checking of the contact condition of the power supply system is completed.

If FB equals GND level, all of signal system terminals are switched into Vcc level in step S5. In step S6, the signal level of warning signal (FB) output from the warning signal output terminal 601 will be monitored; if the FB equals Vcc level (usually 5V) then the process ends because it judges that all contacts of signal system terminals are normal. On the other hand, if the FB equals GND level, it is judged in step S7 that some of signal system terminals including the logical circuit power supply input terminal 108 and the warning signal output terminal 601 are pulled down; in other words there is contact inferiority, and then the process advances to step S8. In step S8, the LCD 1713 indicates a message to that effect, the LED 1711 lights up and the buzzer 1712 rings, then the process ends. In steps S5 to S8, checking of the contact condition of the signal system is completed.

Although the control circuit of the recording apparatus IJRA automatically performs the above process at power on, before the recording operation and so on, it may be able to perform the process at any timing according to an indication by the switch (SW) 1714. By such a process, when terminals have contact inferiority, the LED 1711 lights up, the buzzer 1712 rings, the LCD and 1713 indicates the message, so a user has a chance to cope with the problem, for example, to confirm an installation condition of recording head IJH, reinstall it or exchange it.

According to the embodiment, since it is possible to detect the contact inferiority by checking the connection condition of the recording head and the recording apparatus before recording, it can be prevented from being destroyed by contact inferiority and from recording poorly.

<Second Embodiment>

Figure 7:
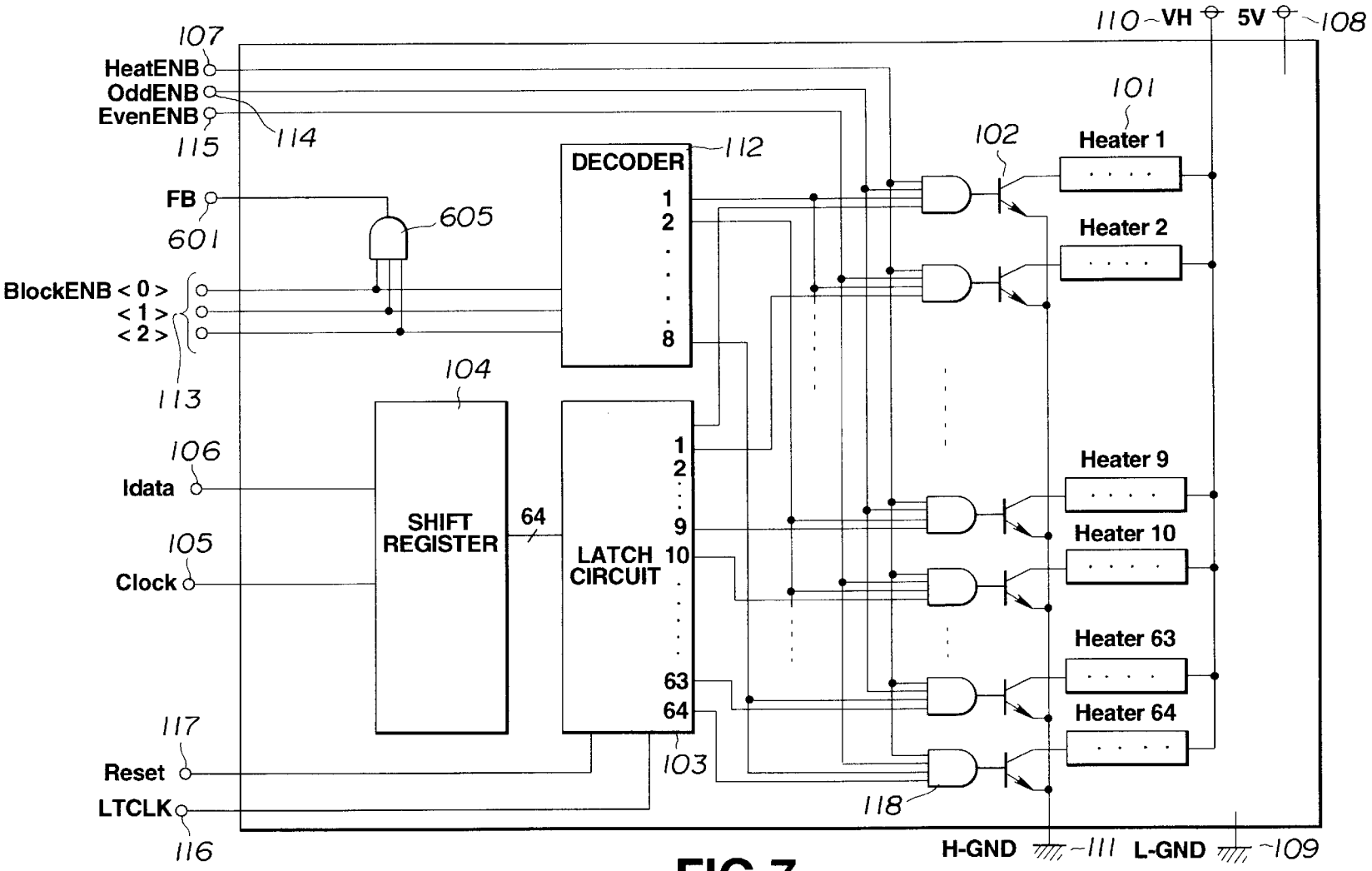
FIG. 7 is a block diagram showing structure of a circuit board of the recording head IJH according to another embodiment.

The recording head explained in the first embodiment detects contact inferiority of all signal system terminals. However, the present invention is not limited to the details of that embodiment. As explained above, it is only the block select signals that cause the destruction of the recording head when terminals have contact inferiority. Accordingly, as shown in FIG. 7 in this embodiment, an AND circuit 605 operates logical product of only the 3-bit block select signals (BlockENB) and the operation result is output as the warning signal (FB).

In the above embodiments, recording paper is an example of the recording medium, but the present invention is not limited to that. Ink support material that can receive ink such as cloth, thread and a sheet can be utilized as the recording medium.

According to the present invention, since the connection condition between the recording head and the recording apparatus can be informed to the user, the user can always know the connection condition.

By virtue of this feature, the user can have a chance to cope with the problem, for example, to confirm an installation condition of recording head, reinstall it or exchange it. So the user can prevent the recording head from being destroyed due to contact inferiority and from recording poorly.

The ink jet recording apparatus using heating elements as recording elements is an example of a recording apparatus, but the present invention is not limited to that. The present invention can be applied to other recording apparatuses such as a thermal recording apparatus using heating elements, a LED recording apparatus using LED elements, and an impact recording apparatus using wire elements as recording elements.

Typical structures and operational principles of such devices to which the present invention can be applied, can preferably be such as those disclosed in U.S. Pat. Nos. 4,723,129 and 4,740,796. Those principles and structures are applicable to a so-called on-demand type recording system and to a continuous type recording system, but are particularly suitable to the on-demand type. Such an approach adopts the principle that at least one driving signal is applied to an electrothermal transducer disposed on a liquid (ink) retaining sheet or in a liquid passage, the driving signal being sufficient to provide a quick temperature rise beyond a departure-from-nucleation boiling point. The thermal energy provided by the electrothermal transducer produces film boiling on the heating portion of the recording head, whereby a bubble can be formed in the liquid (ink), in response to each driving signal. The production, development and contraction of the bubble cause ejection of the liquid (ink) through an ejection outlet to produce at least one droplet. The driving signal is preferably in the form of a pulse, because this enables the development and contraction of the bubble to be effected instantaneously, and therefore, the liquid (ink) is ejected with quick response to the driving signal. The pulse-shaped driving signal is preferably formed as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600, wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670, wherein a common slit is used as the ejection outlet for plural electrothermal transducers, and to the structure disclosed in Japanese Laid-Open Patent Application No. 59-138461, wherein an opening for absorbing pressure waves of the thermal energy is formed corresponding to the ejecting portion. This is because the present invention is effective to perform recording with certainty and at high efficiency regardless of the type of recording head.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

Provision of the recovery means and/or the auxiliary means for the preliminary operation is preferable, because those features can further stabilize the effects of the present invention. Examples of such means include a capping means for the recording head, cleaning means therefor, pressurizing or suction means for keeping the ink ejection outlets or orifices clean, and preliminary heating means (which may be an electrothermal transducer, an additional heating element or a combination thereof). Also, means for effecting preliminary ejection (to precede the actual recording operation) can stabilize the recording operation.

The recording head may be a single head which records using a single color ink, or may be plural heads corresponding to plural ink materials having different recording colors or densities. The present invention is effectively applied to an apparatus having at least one of a monochromatic mode (using black ink, most commonly), a multi-color mode using different color ink materials, and/or a full-color mode using a mixture of colors, which may be an integrally-formed recording unit or a combination of plural recording heads.

The ink jet recording apparatus may be used as an output terminal of an information processing apparatus such as a computer or the like, as a copying apparatus when combined with an image reader or the like, or as a facsimile machine having information sending and receiving functions.

The entire disclosures of U.S. Pat. Nos. 4,740,796; 4,723,129; 4,558,333; 4,463,359; 4,459,600; and 4,345,262, and those of Japanese Laid-Open Patent Application Nos. 54-56847, 59-123670, 59-138461, and 60-71260, are incorporated herein by reference.

While the invention has been described with reference to the preferred structures disclosed herein, it is not confined to the details set forth above; to the contrary, many modifications and variations thereof will be readily apparent to those skilled in the art, and this application is intended to cover all such modifications or changes as may come within the purposes of the disclosed improvements disclosed above, within the scope of the following claims.

We claim:

1. A recording head having a plurality of recording elements divided into a plurality of blocks, said recording head comprising:

a select signal terminal for inputting a select signal that designates at least one block among the plurality of blocks to be driven;

a selector for selecting at least one block designated by the select signal;

a monitor for monitoring a connection condition of said select signal terminal; and a monitor terminal for outputting a monitor signal to indicate the monitored connection condition.

2. A head according to claim 1, further comprising an image signal terminal for inputting an image signal, wherein said monitor monitors a connection condition of said image signal terminal.

3. A head according to claim 1, wherein the select signal comprises a plurality of bits, and said monitor comprises an AND circuit for operating logical product of the plurality of bits of the select signal and monitors the connection condition based on the logical product.

4. A head according to claim 1, further comprising means for setting a reference voltage to said select signal terminal when said select signal terminal is not connected.

5. A head according to claim 4, wherein said setting means comprises a pull up resistance connected to said select signal terminal to set high voltage to said select signal terminal when said select signal terminal is not connected.

6. A head according to claim 4, wherein said setting means comprises a pull down resistance connected to said select signal terminal to set low voltage to said select signal terminal when said select signal terminal is not connected.

7. A head according to claim 1, wherein said recording head effects recording by discharging a recording liquid.

8. A head according to claim 1, wherein the plurality of recording elements comprise heating elements that generate thermal energy upon being driven.

9. A head according to claim 8, wherein the recording liquid is discharged by using the thermal energy.

10. A recording head according to claim 1, further comprising a plurality of select signal terminals disposed in parallel.

11. An ink jet head cartridge comprising:

a recording head having a plurality of recording elements divided into a plurality of blocks, said recording head comprising a select signal terminal for inputting a select signal that designates at least one block among the plurality of blocks to be driven, a selector for selecting at least one block designated by the select signal, a monitor for monitoring a connection condition of said select signal terminal, and a monitor terminal for outputting a monitor signal to indicate the monitored connection condition; and an ink tank for holding ink to be supplied to said recording head.

12. A cartridge according to claim 11, wherein said ink tank is filled with the ink.

13. An ink jet head cartridge according to claim 11, further comprising a plurality of select signal terminals disposed in parallel.

14. A recording apparatus for recording onto a recording medium using a recording head having a plurality of recording elements divided into a plurality of blocks, a select signal terminal for inputting a select signal that designates at least one block among the plurality of blocks to be driven, a selector for selecting at least one block designated by the select signal, a monitor for monitoring a connection condition of the select signal terminal, and a monitor terminal for outputting a monitor signal to indicate the monitored connection condition, said recording apparatus comprising:

means for applying a predetermined voltage to the select signal terminal;

means for inputting the monitor signal outputted from the monitor terminal; and means for informing a user of the monitored connection condition between the recording head and said recording apparatus according to the monitor signal.

15. A recording apparatus according to claim 14, further comprising a plurality of select signal terminals disposed in parallel.

16. A recording apparatus for recording onto a recording medium, said recording apparatus comprising:

a recording head having a plurality of recording elements divided into a plurality of blocks, wherein said recording head comprises a select signal terminal for inputting a select signal that designates at least one block among the plurality of blocks to be driven, a selector for selecting at least one block designated by the select signal, a monitor for monitoring a connection condition of said select signal terminal, and a monitor terminal for outputting a monitor signal to indicate the monitored connection condition;

means for applying a predetermined voltage to said select signal terminal;

means for inputting the monitor signal outputted from said monitor terminal; and means for informing a user of the monitored connection condition between said recording head and said recording apparatus according to the monitor signal.

17. An apparatus according to claim 16, wherein said informing means comprises at least one of a buzzer, a display and an LCD.

18. An apparatus according to claim 16, wherein said applying means applies the predetermined voltage to said select signal terminal at power on or before a recording operation.

19. An apparatus according to claim 16, further comprising means for indicating a timing when said applying means applies the predetermined voltage to said select signal terminal.

20. An apparatus according to claim 16, further comprising an image signal terminal for inputting an image signal, wherein said monitor monitors a connection condition of said image signal terminal.

21. An apparatus according to claim 16, wherein the select signal comprises a plurality of bits, and said monitor comprises an AND circuit for operating logical product of the plurality of bits of the select signal and monitors the connection condition based on the logical product.

22. An apparatus according to claim 16, further comprising means for setting a reference voltage to said select signal terminal when said select signal terminal is not connected.

23. An apparatus according to claim 22, wherein said setting means comprises a pull up resistance connected to said select signal terminal to set high voltage to said select signal terminal when said select signal terminal is not connected.

24. An apparatus according to claim 22, wherein said setting means comprises a pull down resistance connected to said select signal terminal to set low voltage to said select signal terminal when said select signal terminal is not connected.

25. An apparatus according to claim 16, wherein said recording head effects recording by discharging a recording liquid.

26. An apparatus according to claim 16, wherein said plurality of recording elements comprise heating elements that generate thermal energy upon being driven.

27. An apparatus according to claim 26, wherein said recording head discharges the recording liquid by using the thermal energy.

28. An apparatus according to claim 16, further comprising a plurality of recording heads, wherein each of said recording heads records in a different color.

29. An apparatus according to claim 16, wherein said recording apparatus is utilized as a terminal for a computer.

30. An apparatus according to claim 16, further comprising an image scanner connected to provide image data to be recorded by the recording head, such that said recording apparatus can function as a copying machine.

31. An apparatus according to claim 16, further comprising an image scanner connected to provide image data and a data transmitting and receiving unit for transmitting the image data to a recipient at another location and for receiving image data from another machine, such that said recording apparatus can function as a facsimile machine.

32. An apparatus according to claim 16, further comprising transport means for transporting the recording medium.

33. A recording apparatus according to claim 16, further comprising a plurality of select signal terminals disposed in parallel.

34. A checking method for checking a connection condition between a recording head and a recording apparatus, said checking method comprising the steps of:

providing a recording head having a plurality of recording elements divided into a plurality of blocks, wherein the recording head comprises a select signal terminal for inputting a select signal that designates at least one block among the plurality of blocks to be driven, a selector for selecting at least one block designated by the select signal, a monitor for monitoring a connection condition of the select signal terminal, and a monitor terminal for outputting a monitor signal to indicate the monitored connection condition;

applying a predetermined voltage to the select signal terminal;

monitoring the monitor signal outputted from the monitor terminal; and informing a user of the monitored connection condition between the recording head and the recording apparatus according to the monitor signal.

35. A method according to claim 34, wherein said applying step comprises the steps of applying a first level voltage to check a contact condition of a power supply system terminal and applying a second level voltage to check the contact condition of the select signal terminal.

36. A method according to claim 35, wherein the first level voltage is ground level.

37. A method according to claim 35, wherein the second level voltage is high level.

38. A checking method according to claim 34, further comprising a plurality of select signal terminals disposed in parallel.

* * * * *